US011183159B1

(12) United States Patent
Adinolfi

(10) Patent No.: US 11,183,159 B1
(45) Date of Patent: Nov. 23, 2021

(54) ELECTRIC, ELECTRO ACOUSTIC, OR ACOUSTIC DRUM WITH INTERNAL WIRING HARNESS

(71) Applicant: Alfonso M Adinolfi, Seattle, WA (US)

(72) Inventor: Alfonso M Adinolfi, Seattle, WA (US)

( * ) Notice: Subject to any disclaimer, the term of this patent is extended or adjusted under 35 U.S.C. 154(b) by 0 days.

(21) Appl. No.: 16/897,268

(22) Filed: Jun. 10, 2020

(51) Int. Cl.

| | |
|---|---|
| ***G10D 13/02*** | (2020.01) |
| ***G10D 13/10*** | (2020.01) |
| ***G10H 3/14*** | (2006.01) |
| ***H01B 7/00*** | (2006.01) |
| ***H01B 7/08*** | (2006.01) |

(52) U.S. Cl.
CPC ..... *G10D 13/02* (2013.01); *G10D 13/10* (2020.02); *G10H 3/146* (2013.01); *H01B 7/0045* (2013.01); *H01B 7/08* (2013.01)

(58) Field of Classification Search
CPC ..... G10D 13/02; G10D 13/10; G10H 3/146; H01B 7/0045; H01B 7/08
USPC ..... 84/411 R
See application file for complete search history.

(56) References Cited

U.S. PATENT DOCUMENTS

| | | | | | |
|---|---|---|---|---|---|
| 3,956,959 | A * | 5/1976 | Ebihara | G10D 13/08 | 84/725 |
| 4,242,937 | A * | 1/1981 | Pozar | G10H 3/146 | 84/725 |
| 4,648,302 | A * | 3/1987 | Bozzio | G10H 3/146 | 84/730 |
| 5,042,356 | A * | 8/1991 | Karch | G10D 13/26 | 84/725 |
| 5,293,000 | A * | 3/1994 | Adinolfi | G10H 3/146 | 84/730 |
| 5,345,037 | A * | 9/1994 | Nordelius | G10H 3/146 | 84/730 |
| 5,353,674 | A * | 10/1994 | Volpp | G10D 13/02 | 84/411 R |
| 5,811,709 | A * | 9/1998 | Adinolfi | G10D 13/26 | 84/723 |
| 5,841,052 | A * | 11/1998 | Stanton | G10H 1/34 | 84/600 |
| 5,929,355 | A * | 7/1999 | Adinolfi | G10H 1/32 | 84/421 |
| 5,977,473 | A * | 11/1999 | Adinolfi | G10D 13/02 | 84/723 |
| 6,121,528 | A * | 9/2000 | May | G10D 13/02 | 84/411 R |
| 6,215,055 | B1 * | 4/2001 | Saravis | G10H 1/348 | 84/422.1 |
| 7,179,985 | B2 * | 2/2007 | Pickens | G10H 3/12 | 84/743 |

(Continued)

*Primary Examiner* — Christina M Schreiber
(74) *Attorney, Agent, or Firm* — Alloy Patent Law; Walker Griffin Weitzel

(57) ABSTRACT

Electric, Electro Acoustic or Acoustic Drum with Internal Wiring Harness is disclosed herein. The drum comprises an internal wiring harness configuration. The internal wiring harness configuration comprises a plurality of first audio jacks that are mounted on an internal surface of the drum. The internal wiring harness configuration further comprises a connector assembly configuration comprising a plurality of second audio jacks and a multi-pin connector mounted on an external surface of the bass drum. Such configuration eliminates long cables and cumbersome wiring and provides a more natural and desirable connection to external processing.

13 Claims, 3 Drawing Sheets

(56) References Cited

U.S. PATENT DOCUMENTS

Figure 1:
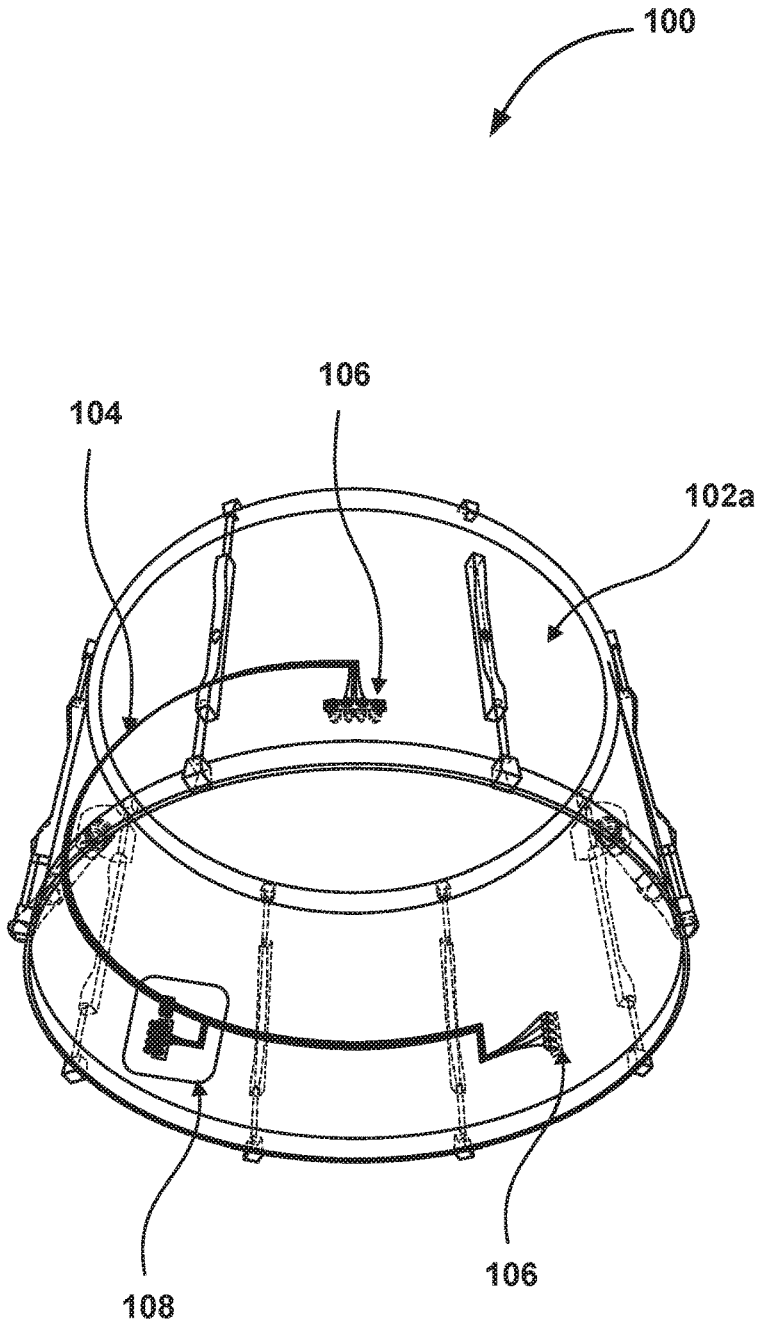

| | | | | |
|---|---|---|---|---|
| 7,282,633 | B1 * | 10/2007 | Coolidge | G10H 3/143 84/104 |
| 7,297,863 | B2 * | 11/2007 | May | G10H 1/32 84/104 |
| 9,589,552 | B1 * | 3/2017 | Nishi | G10D 13/26 |
| 9,601,099 | B2 * | 3/2017 | Steele | G10D 13/02 |
| 9,972,296 | B2 * | 5/2018 | Steele | G10H 1/348 |
| 10,546,569 | B1 * | 1/2020 | Hawdon | G10H 3/12 |
| 2004/0105245 | A1 * | 6/2004 | Kelly | H01B 7/0045 361/826 |
| 2006/0021495 | A1 * | 2/2006 | Freitas | G10H 3/12 84/723 |
| 2006/0272490 | A1 * | 12/2006 | May | G10H 3/146 84/743 |
| 2008/0121088 | A1 * | 5/2008 | Curet Troche | G10D 13/10 84/413 |
| 2009/0007763 | A1 * | 1/2009 | Steele | G10H 3/146 84/746 |
| 2009/0151542 | A1 * | 6/2009 | Gain | G10H 1/18 84/603 |
| 2011/0259175 | A1 * | 10/2011 | Mollick | H04R 1/08 84/421 |
| 2014/0208925 | A1 * | 7/2014 | Osborne | G10D 13/02 84/725 |
| 2015/0379977 | A1 * | 12/2015 | Steele | G10H 3/146 84/723 |
| 2016/0217777 | A9 * | 7/2016 | Steele | G10D 13/02 |
| 2017/0125002 | A1 * | 5/2017 | Steele | G10H 1/348 |
| 2019/0019479 | A1 * | 1/2019 | Strickland | G10D 13/02 |
| 2020/0105236 | A1 * | 4/2020 | Fifelski | G10H 1/12 |

* cited by examiner

ELECTRIC, ELECTRO ACOUSTIC, OR ACOUSTIC DRUM WITH INTERNAL WIRING HARNESS

CROSS-REFERENCE TO RELATED PATENT DOCUMENTS

This patent application claims the benefit of priority of U.S. Provisional Application No. 62/856,913 entitled "Electric, Electro Acoustic or Acoustic Drum with Internal Wiring Harness," filed Jun. 4, 2019, which is hereby incorporated herein by reference in its entirety.

FIELD OF THE INVENTION

The present disclosure generally relates to the field of musical drums, and more particularly to an electric, electro acoustic, or acoustic drum with internal wiring harness. The drum has been presented herein for pick-up, processing, amplification, and user adjustment of acoustic sound and tonal characteristics. The use of internal wiring harness configuration eliminates the need for multiple wires to connect a drum set to a sound source or a public address system (PA system). Further, such configuration eliminates long cables and cumbersome wiring and provides a more natural and desirable connection to external processing.

BACKGROUND

Generally, a musical drum comprises a solid shell and one or two tunable membranes that are locked into an annular frame, generally referred to as a drumhead, which is tensioned over the shell. In order to facilitate the proper tension to the drumhead, the shell has an arrangement of tensioning lugs attached to it, with threaded tension rods extending from the tensioning lugs. During installation, the drumhead with an annular frame is placed over the shell and a counter hoop, or rim, is placed over the annular frame. The tension rods engage the counter hoop and the tensioning lugs are tightened to stretch the drumhead membrane. By adjusting the torque of the tension rods within the tensioning lugs, the stretched drumhead membrane changes pitch. By tightening the tensioning lugs, the tension rods pull on the counter hoop to tension the drumhead membrane thereby increasing the pitch when a striking force is applied to the drumhead membrane, i.e., by striking the drumhead membrane with a drumstick. Conversely, loosening the tensioning lugs permits the tension rods to release tension on the counter hoop thereby lowering the pitch of the drumhead membrane when a striking force is applied. The stretching of the drumhead membrane to the desired tension generates musical and playing characteristics of the drum when a striking force is applied, including pitch, stick rebound, or the like.

More recently, electronic drums are becoming more popular too. These electronic drums create drum sounds without the typical size and acoustic volume of conventional musical drums. The electronic drums are generally formed of pads with sensors in order to generate an electrical signal when a striking force is applied to the drum pad or head. More sophisticated electronic drum sets include additional or more complex sensors that distinguish between differences in the amount of force used to strike the pad and the location of the force on the pad, in an effort to simulate the sounds generated by a conventional drum that differentiates between those and other factors. The electronic drums permit a drummer to play in practice environments without the volumes associated with playing conventional drums, generating external volumes no louder than striking the pads, while listening to the sampled sounds through headphones. Additionally, it permits the signal to be amplified and sent to speakers for use in performance environments.

However, the range of sampled sounds provided by a computer module, and the processing of those sounds, are limited in the range of different sounds and tones. Moreover, the sounds created are manipulated to replicate the sounds of conventional acoustic drums, but lack the dynamic range and variations associated with acoustic drums. Moreover, these drums require long individual wires to connect to a processing equipment. Long wires are hard to manage, confusing to connect, and aesthetically detract from the look of the drum set. They are also likely to fail from constant connection and disconnection and pose a constant danger of tripping over and damaging the equipment they are connected to. It is therefore an object of the invention to provide an electric, electro acoustic, or acoustic drum with internal wiring harness that produces lower volume acoustic signals that can be electronically picked up, processed, and amplified. This will eliminate the need for multiple wires to connect a drum set to a sound source or public address system (PA system). Moreover, the disclosed drum set eliminates long cables and cumbersome wiring and provides a more natural and desirable connection to external processing system.

SUMMARY

It will be understood that this disclosure is not limited to the particular systems and apparatus described herein, as there can be multiple possible embodiments of the present disclosure which are not expressly illustrated in the present disclosure. It is also to be understood that the terminology used in the description is for the purpose of describing the particular versions or embodiments only and is not intended to limit the scope of the present disclosure.

An objective of the present invention is to provide an electric, electro acoustic, or acoustic drum with internal wiring harness configuration. Such configuration eliminates the need for multiple wires to connect a drum set to sound source or PA system. Further, such configuration eliminates long cables and cumbersome wiring and provides a more natural and desirable connection to external processing.

The drum set includes internal multi point wiring that leads to a single source and exiting the bass drum and connecting to outboard processing. The claimed invention differs from what currently exists. All connections to external processing are routed through the bass drum and exit at a single point.

Long wires are hard to manage, confusing to connect, and aesthetically detract from the look of the drum set. They are also likely to fail from constant connection and disconnection and pose a constant danger of tripping over and damaging the equipment they are connected to. The drum set arrangement disclosed herein eliminates the need for multiple wires to connect a drum set to sound source or PA system. Further, such configuration eliminates long cables and cumbersome wiring and provides a more natural and desirable connection to external processing. That being the preface, the purpose of this invention is to eliminate the need for external wiring connecting individual components of an electric drum set to a sound module by means of an internal wiring system, thereby allowing all connections to be made through the bass drum or host instrument, by utilizing one main "umbilical" connector to reach the sound source/module or MIDI (Musical Instrument Digital Interface)

device. These connections may be made from instrument or speaker cords of any gauge and utilizing any standard or custom made connecting hardware with some standard examples being ¼ inch or 3.5 mm mono and stereo audio jacks, XLR, MIDI Din, USB, and/or RCA connectors to receive signals from individual drums, multi pads and various electronic components utilizing either piezo transducers or FSR (Force Sensitive resistors) for the purpose of triggering any synthesized or "sampled" patch or sound contained on the sound source/module as well as audio signals generated from individual microphones. The configuration of the wiring harness may be customized with any combination of connecting hardware to address the need of the particular application.

In another example, the internal wiring may also be constructed to receive signals from modules using "phantom power" to enable the use of active electronic components such as pads or triggers utilizing the FSR technology. In this particular example, the harness may utilize any applicable gauge of shielded ribbon cable or standard shielded cable and may conform to the inside circumference of the bass drum, with any combination of connectors located strategically to accommodate a traditional, standard drum set configuration but not restricted to that configuration. These connections may be of any type and number that can be supported by the cylinder of installation without compromise to the electronic or structural integrity of the instrument.

This internal wiring harness may also be applied to any of the individual drums, instruments, or cylinders that a builder cares to install and are not restricted to the bass drum. The umbilical connector from the host drum or cylinder to the sound source, module, or PA system may carry all signals by means of a single "snake" cord with multi pinned connectors on each end that are capable of transmitting the appropriate number and type of signals to trigger the desired sound, patch, or channel. In one example, this connection may be a standard DB-25 connector but any of numerous available multi pin connectors may be used to accommodate the application and no restriction is anticipated as long as the source and receptor connectors are compatible.

These and other features and advantages of the present invention will become apparent from the detailed description below, in light of the accompanying drawings.

BRIEF DESCRIPTION OF ACCOMPANYING DRAWINGS

Figure 2:
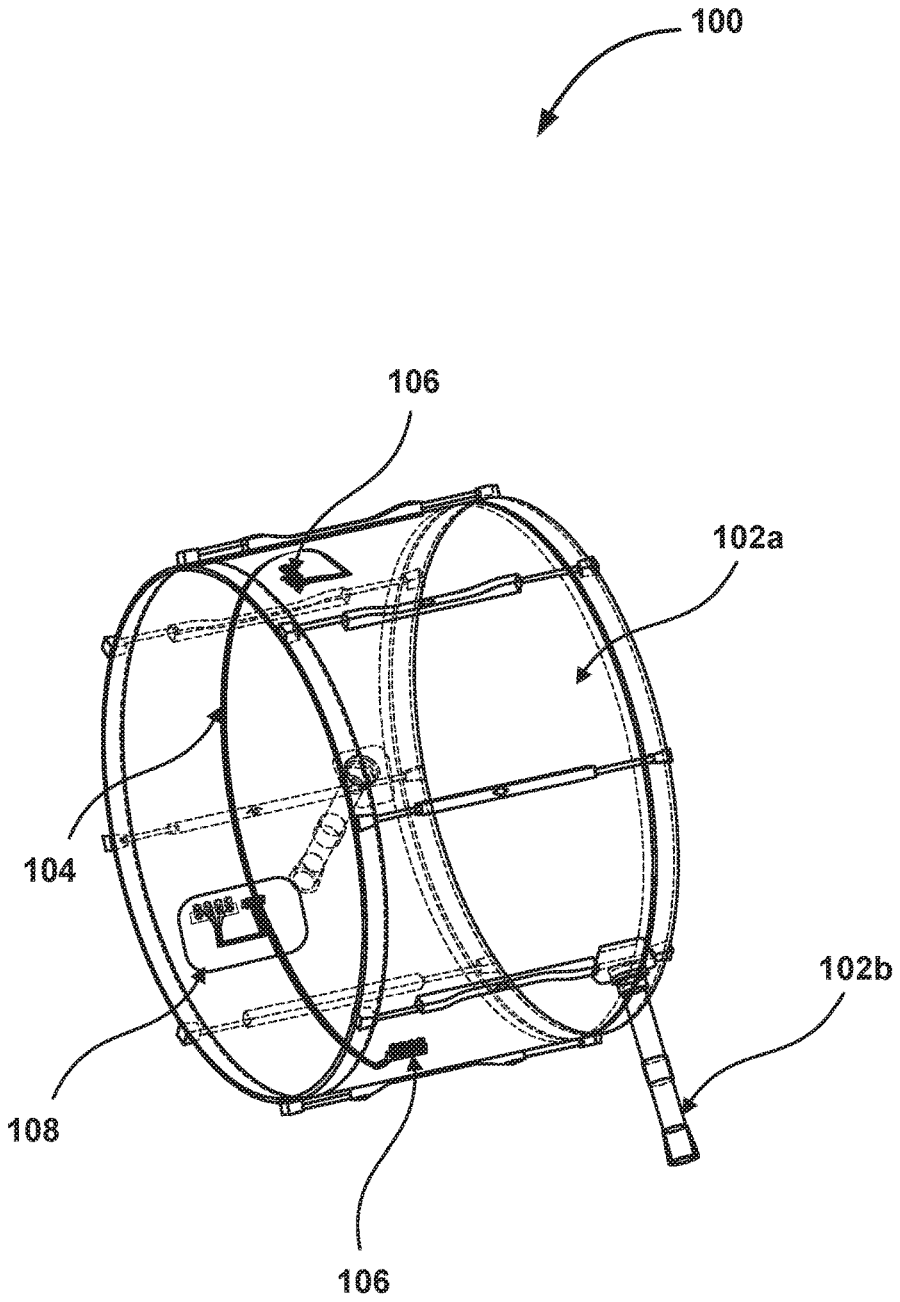
Figure 3:
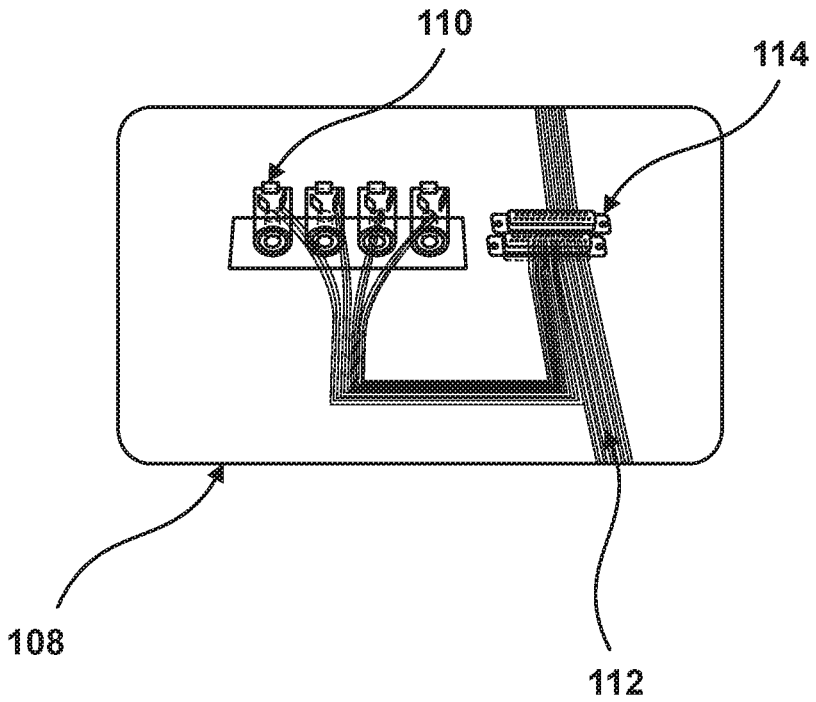

The novel features which are believed to be characteristic of the present invention, as to its structure, organization, use and method of operation, together with further objectives and advantages thereof, will be better understood from the following drawings in which a presently preferred embodiment of the invention will now be illustrated by way of various examples. It is expressly understood, however, that the drawings are for the purpose of illustration and description only and are not intended as a definition of the limits of the invention. Embodiments of this invention will now be described by way of example in association with the accompanying drawings in which:

FIGS. 1 and 2 are diagrams that individually illustrates a top perspective view of a bass drum, according to an exemplary embodiment of the present invention; and FIG. 3 is a diagram that illustrates a connector assembly configuration of the bass drum, according to an exemplary embodiment of the present invention.

DETAILED DESCRIPTION

As used in the specification and claims, the singular forms "a", "an" and "the" may also include plural references. For example, the term "an article" may include a plurality of articles. Those with ordinary skill in the art will appreciate that the elements in the figures are illustrated for simplicity and clarity and are not necessarily drawn to scale. For example, the dimensions of some of the elements in the figures may be exaggerated, relative to other elements, in order to improve the understanding of the present invention. There may be additional components described in the foregoing application that are not depicted on one of the described drawings. In the event such a component is described, but not depicted in a drawing, the absence of such a drawing should not be considered as an omission of such design from the specification.

Before describing the present invention in detail, it should be observed that the present invention utilizes a combination of components, which constitutes an electric, electro acoustic, or acoustic drum with internal wiring harness. The use of internal wiring harness configuration eliminates the need for multiple wires to connect a drum set to a sound source or a public address system (PA system). Further, such configuration eliminates long cables and cumbersome wiring and provides a more natural and desirable connection to external processing. Accordingly, the components have been represented, showing only specific details that are pertinent for an understanding of the present invention so as not to obscure the disclosure with details that will be readily apparent to those with ordinary skill in the art having the benefit of the description herein. As required, detailed embodiments of the present invention are disclosed herein; however, it is to be understood that the disclosed embodiments are merely exemplary of the present invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the present invention.

References to "one embodiment", "an embodiment", "another embodiment", "yet another embodiment", "one example", "an example", "another example", "yet another example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment.

The words "comprising", "having", "containing", and "including", and other forms thereof, are intended to be equivalent in meaning and be open ended in that an item or items following any one of these words is not meant to be an exhaustive listing of such item or items or meant to be limited to only the listed item or items.

Unless stated otherwise, terms such as "first" and "second" are used to arbitrarily distinguish between the elements or entities. Thus, these terms are not necessarily intended to indicate temporal or other prioritization of such elements or priorities. While various exemplary embodiments of the disclosed systems and apparatuses have been described below, it should be understood that they have been presented for purposes of example only, and not limitations. It is not exhaustive and does not limit the present invention to the precise form disclosed. Modifications and variations are possible in light of the below teachings or may be acquired from practicing of the present invention, without departing from the breadth or scope.

The electric, electro acoustic, or acoustic drum with an internal wiring harness configuration of the present invention will now be described with reference to the accompanying drawings, which should be regarded as merely illustrative without restricting the scope and ambit of the present invention. Embodiments of the present invention will now be described with reference to FIGS. 1-3.

FIGS. 1 and 2 are diagrams that individually illustrates a top perspective view of a bass drum 100, according to an exemplary embodiment of the present invention. FIGS. 1 and 2 gives an overview of one or more essential parts of the bass drum 100 in accordance with an exemplary embodiment of the present invention. The bass drum 100 includes a cylindrical outer shell 102*a*. The bass drum 100 further includes one or more legs such as a leg 102*b* that is essential for stabilizing the bass drum 100. The bass drum 100 may further include tom-tom mounts that are widely available for prior art acoustic bass drums and may be useable in the invention as well. All other percussion instrument mounting systems designed for conventional acoustic bass drums may work on this bass drum 100 as well without limiting the scope of the invention. The bass drum 100 may further include an attachment point for mounting a bass drum pedal at the rear. The bass drum 100 may further include a kick pad that is installed for striking with the bass drum pedal. The electronic kick pad signal is sent to an integral bass drum module. There may be an MP3 player receptacle that allows a drummer to practice along with music. The bass drum 100 may further include several dual-purpose input jacks.

In an embodiment, the bass drum 100 further includes an internal wiring harness configuration 104. The internal wiring harness configuration 104 includes audio jacks 106. Each of the audio jacks 106 is a ¼ inch or 3.5 mm female mono or TRS audio jack. The internal wiring harness configuration 104 further includes a connector assembly configuration 108. In an exemplary embodiment, the internal wiring harness configuration 104 may be formed by using a shielded ribbon cable (or any other types of shielded wiring) that is physical connected to an internal surface of the bass drum 100 by use of chemical adhesive, metal clips, plastic clips, or any combination thereof and conforming to an inside curvature of the bass drum 100 as shown in FIG. 1. Wires are then routed to any assigned area of the bass drum 100 (typically at the top and lower sides) which has been pre drilled to allow through-hole wiring connections to any type of audio or electronic input connectors (typically either 3.5 mm or ¼ inch mono or TRS female audio input jacks as shown in FIG. 2) which are mounted on metal or plastic plates which also conform to the curvature of the bass drum 100 and seated into the selected external surface area of the bass drum 100. All audio jacks are then routed and connected to any type multi pin connector (for example, a DB-25) which mounts on the external surface of the bass drum 100 to provide a single point connection to external processing as shown in FIG. 3. That being the preface, the purpose of this invention is to eliminate the need for external wiring connecting individual components of an electric drum set to a sound module by means of an internal wiring system allowing all connections to be made through the bass drum or host instrument, by utilizing one main "umbilical" connector to reach the sound source/module or MIDI (Musical Instrument Digital Interface) device.

In an embodiment, these connections may be made from instrument or speaker cords of any gauge and utilizing any standard or custom-made connecting hardware with some standard examples being ¼ inch or 3.5 mm mono and stereo jacks, XLR, MIDI Din, USB, and/or RCA connectors to receive signals from individual drums, multi pads, and various electronic components utilizing either piezo transducers or FSR (Force Sensitive resistors) for the purpose of triggering any synthesized or "sampled" patch or sound contained on the sound source/module. The configuration 104 of the wiring harness may be customized with any combination of connecting hardware to address the need of a particular application. In another example, the internal wiring may also be constructed to receive signals from modules using "phantom power" to enable the use of active electronic components such as pads or triggers utilizing the FSR technology. In this particular example, the harness will utilize any applicable gauge of the shielded ribbon cable or standard shielded cable and will conform to the inside circumference of the bass drum 100, with any combination of connectors located strategically to accommodate a traditional, standard drum set configuration but not restricted to that configuration. These connections may be of any type and number a manufacture believes can be supported by the cylinder of installation without compromising to the electronic or structural integrity of the instrument.

This internal wiring harness configuration 104 may also be applied to any of the individual drums, instruments, or cylinders that a builder cares to install and are not restricted to the bass drum 100. The umbilical connector from the host drum/cylinder to the sound source/module may carry all signals by means of a single "snake" cord with multi pinned connectors on each end capable of transmitting the appropriate number and type of signals to trigger the desired sound, patch, or channel. In one example, this connection may be a standard DB-25 connector but any of numerous available multi pin connectors may be used to accommodate the required application and no restriction is anticipated as long as the source and receptor connectors are compatible.

FIG. 3 is a diagram that illustrates the connector assembly configuration 108 of the bass drum, according to an exemplary embodiment of the present invention. The connector assembly configuration 108 includes one or more audio jacks 110. Each of the audio jacks 110 is a ¼ inch or 3.5 mm female mono or TRS audio jack. The connector assembly configuration 108 further includes a shielded ribbon cable or multi-conductor wiring 112. The connector assembly configuration 108 further includes the multi-pin connector 114. The multi-pin connector 114 may be a DB 25 multi-pin connector. In an exemplary embodiment, the surface mounted jacks 110 may be used to connect all other mounted or freestanding percussion instruments directly to the bass drum 100 and then route to an external processing equipment. In order to make the invention, flush mounted wires may be connected to the internal surface of the drum and routing the wires through drilled and routed points of the shell wall and connecting to the audio jacks 110 and multi pin connectors 114 mounted on the external surface of the drum 100. Here, any audio jack may be replaced by another jack of similar function or value in any size or configuration without limiting the scope of the invention. Audio jacks may also be added up to the limits of available inputs of the multi pin connector 114.

Thus, various embodiments of the bass drum 100 with internal wiring system as disclosed herein eliminates the need for multiple wires to connect a drum set to sound source or PA system. The bass drum 100 may be used by connecting an entire electric or acoustic drum set to external sound source, PA system, or processing gear using short, lightweight mono or TRS audio and/or MIDI or XLR cables and plugging into a central junction mounted into an acoustic or electric bass drum. Such configuration eliminates long cables and cumbersome wiring and provides a more natural and desirable connection to external processing. bass drum 100 with internal wiring system eliminates the need for long individual wires to connect a module, sound source, or PA via a single multi pin connector. The bass drum 100 comprises the internal wiring harness configuration 104. The internal wiring harness configuration 104 comprises a plurality of first audio jacks (such as the audio jacks 106) that are mounted on an internal surface of the bass drum 100. The internal wiring harness configuration 104 further comprises the connector assembly configuration 108 comprising a plurality of second audio jacks (such as the audio jacks 110) and the multi-pin connector 114 mounted on an external surface of the bass drum 100. In an embodiment, flush mounted wires are connected to the internal surface of the bass drum 100 and routing the wires through drilled and routed points of a shell wall and connecting to the plurality of second audio jacks and the multi pin connector mounted on the external surface of the bass drum 100. The bass drum 100 is an electric, electro acoustic, or acoustic drum. The bass drum 100 further comprise a plurality of legs that are essential for stabilizing the bass drum 100. In an embodiment, each of the plurality of first audio jacks and each of the plurality of second audio jacks is a ¼ inch or 3.5 mm female mono or TRS audio jack. In an embodiment, the internal wiring harness configuration is formed by using a shielded ribbon cable. The shielded ribbon cable is physically connected to the internal surface of the bass drum 100. The shielded ribbon cable is physically connected to the internal surface by using chemical adhesive, metal clips, plastic clips, or any combination thereof and conforming to an inside curvature of the bass drum 100. In an embodiment, the wires are routed to one or more areas of the bass drum 100. The one or more areas correspond to at least a top side area and a lower side area. The one or more areas have been pre drilled to allow through-hole wiring connections to any type of audio or electronic input connectors which are mounted on metal or plastic plates which also conform to a curvature of the bass drum and seated into the external surface area of the bass drum 100. In an embodiment, each of the plurality of first audio jacks and each of the plurality of second audio jacks are routed and connected to the multi-pin connector. The multi-pin connector is a DB-25 multi-pin connector which mounts on the external surface of the bass drum 100 to provide a single point connection to external processing. In an embodiment, internal wiring is constructed to receive signals from modules using phantom power to enable use of active electronic components such as pads or triggers utilizing FSR technology. In an embodiment, the plurality of second audio jacks are used to connect all other mounted or freestanding percussion instruments directly to the bass drum 100 and then route to an external processing equipment. The internal wiring harness configuration eliminates need for multiple wires to connect a drum set to a sound source or a public address system (PA system). In an embodiment, the bass drum is used by connecting an entire electric or acoustic drum set to an external sound source, PA system, or processing gear using short, lightweight mono, or TRS audio and/or MIDI or XLR cables and plugging into a central junction mounted into an acoustic or electric bass drum.

While various embodiments of the disclosure have been illustrated and described, it will be clear that the disclosure is not limited to these embodiments only. Numerous modifications, changes, variations, substitutions, and equivalents will be apparent to those skilled in the art, without departing from the spirit and scope of the disclosure, as described in the claims. Although particular embodiments of the invention have been described in detail for purposes of illustration, various modifications and enhancements may be made without departing from the spirit and scope of the invention. The scope of the invention is accordingly defined by the following claims.

What is claimed is:

1. A bass drum, comprising:

an internal wiring harness configuration comprising:

flush mounted wires, a plurality of first audio jacks that are mounted on an internal surface of the bass drum, and a connector assembly configuration comprising a plurality of second audio jacks and a multi-pin connector mounted on an external surface of the bass drum, wherein the flush mounted wires are connected to the internal surface of the bass drum and routing the wires through drilled and routed points of a shell wall and connecting to the plurality of second audio jacks and the multi pin connector mounted on the external surface of the bass drum, wherein the bass drum is used by connecting an entire electric or acoustic drum set to external sound source using TRS audio and MIDI or XLR cables and plugging into a central junction mounted into an acoustic or electric bass drum such that all connections to external processing are routed through the bass drum and exit at a single point, and wherein this configuration eliminates need for long cables and cumbersome wiring and provides a more natural and desirable connection to the external processing without any signal processing.

2. The bass drum of claim 1, wherein the bass drum is an electric, electro acoustic, or acoustic drum.

3. The bass drum of claim 1, further comprising a plurality of legs that are essential for stabilizing the bass drum.

4. The bass drum of claim 1, wherein each of the plurality of first audio jacks and each of the plurality of second audio jacks is a ¼ inch or 3.5 mm female mono or TRS audio jack.

5. The bass drum of claim 1, wherein the internal wiring harness configuration is formed by using a shielded ribbon cable.

6. The bass drum of claim 5, wherein the shielded ribbon cable is physically connected to the internal surface of the bass drum.

7. The bass drum of claim 6, wherein the shielded ribbon cable is physically connected to the internal surface by using chemical adhesive, metal clips, plastic clips, or any combination thereof and conforming to an inside curvature of the bass drum.

8. The bass drum of claim 7, wherein the wires are routed to one or more areas of the bass drum, and wherein the one or more areas correspond to at least a top side area and a lower side area.

9. The bass drum of claim 8, wherein the one or more areas have been pre drilled to allow through-hole wiring connections to audio or electronic input connectors which are mounted on metal or plastic plates which also conform to a curvature of the bass drum and seated into the external surface area of the bass drum.

10. The bass drum of claim 1, wherein each of the plurality of first audio jacks and each of the plurality of second audio jacks are routed and connected to the multi-pin connector by means of the wires.

11. The bass drum of claim 10, wherein the multi-pin connector is a DB-25 multi-pin connector which mounts on the external surface of the bass drum to provide a single point connection to the external processing.

12. The bass drum of claim 1, wherein internal wiring is constructed to receive signals from modules using phantom power to enable use of active electronic components such as pads or triggers utilizing FSR technology.

13. The bass drum of claim 1, wherein the plurality of second audio jacks are used to connect all other mounted or freestanding percussion instruments directly to the bass drum and then route to an external processing equipment.

* * * * *